US010927596B2

(12) United States Patent
Huang et al.

(10) Patent No.: US 10,927,596 B2
(45) Date of Patent: Feb. 23, 2021

(54) WINDOW SHADE AND ITS SPRING DRIVE SYSTEM

(71) Applicant: TEH YOR CO., LTD., New Taipei (TW)

(72) Inventors: Chin-Tien Huang, New Taipei (TW); Chien-Fong Huang, New Taipei (TW)

(73) Assignee: TEH YOR CO., LTD., New Taipei (TW)

( * ) Notice: Subject to any disclaimer, the term of this patent is extended or adjusted under 35 U.S.C. 154(b) by 294 days.

(21) Appl. No.: 16/117,699

(22) Filed: Aug. 30, 2018

(65) Prior Publication Data

US 2019/0112871 A1 Apr. 18, 2019

(30) Foreign Application Priority Data

Oct. 16, 2017 (TW) ..... 10613531.1

(51) Int. Cl.
*E06B 9/322* (2006.01)
*E06B 9/325* (2006.01)
*E06B 9/262* (2006.01)

(52) U.S. Cl.
CPC ..... *E06B 9/322* (2013.01); *E06B 9/262* (2013.01); *E06B 9/325* (2013.01); *E06B 2009/2627* (2013.01); *E06B 2009/3222* (2013.01)

(58) Field of Classification Search
CPC ..... E06B 9/322; E06B 2009/3222; E06B 2009/3225; A47H 5/02
See application file for complete search history.

(56) References Cited

U.S. PATENT DOCUMENTS 6,024,154 A 2/2000 Wang et al.
6,536,503 B1 * 3/2003 Anderson ..... E06B 9/262 160/170
6,575,223 B1 * 6/2003 Chung ..... E06B 9/32 160/170
6,644,372 B2 * 11/2003 Judkins ..... E06B 9/32 160/170

(Continued)

FOREIGN PATENT DOCUMENTS

CN 203584273 5/2014
TW 363677 U 5/2014
TW 201617513 A 5/2016

OTHER PUBLICATIONS

The Office Action dated Mar. 28, 2018 in co-pending TW Patent Application No. 106135311.

*Primary Examiner* — Beth A Stephen
(74) *Attorney, Agent, or Firm* — Chen Yoshimura LLP

(57) ABSTRACT

A spring drive system for a window shade includes a housing, a plurality of rotary members, a spring and a latch. The rotary members are rotationally linked to one another and pivotally connected with the housing, wherein the rotary members include a rotary drum that is connected with a suspension member and is rotatable relative to the housing for winding or unwinding the suspension member. The spring is assembled with the housing, and can bias the rotary drum in rotation for winding the suspension member. The latch is assembled with the housing, the latch being movable to engage with and disengage from one of the rotary members to respectively prevent and allow rotation of the rotary drum.

28 Claims, 15 Drawing Sheets

(56) References Cited

U.S. PATENT DOCUMENTS

| | | | | |
|---|---|---|---|---|
| 6,644,375 | B2 * | 11/2003 | Palmer | E06B 9/322 160/170 |
| 6,823,925 | B2 * | 11/2004 | Militello | E06B 9/262 160/170 |
| 7,093,644 | B2 * | 8/2006 | Strand | E06B 9/322 160/170 |
| 7,311,134 | B2 * | 12/2007 | Cheng | E06B 9/322 160/170 |
| 7,320,354 | B2 * | 1/2008 | Cheng | E06B 9/322 160/170 |
| 7,406,995 | B2 * | 8/2008 | Huang | E06B 9/322 160/170 |
| 7,575,036 | B2 * | 8/2009 | Cheng | E06B 9/322 160/170 |
| 8,739,853 | B2 * | 6/2014 | Judkins | E06B 9/322 160/170 |
| 9,708,850 | B2 * | 7/2017 | Anderson | E06B 9/262 |
| 9,845,639 | B2 * | 12/2017 | Chen | E06B 9/322 |

* cited by examiner

WINDOW SHADE AND ITS SPRING DRIVE SYSTEM

CROSS-REFERENCE TO RELATED APPLICATION(S)

This US Patent Application claims priority to Taiwan Patent Application No. 106135311 filed on Oct. 16, 2017, the disclosure of which is incorporated herein by reference.

BACKGROUND

1. Field of the Invention

The present invention relates to a spring drive system and window shades using the same.

2. Description of the Related Art

Various types of window shades are currently available on the market, such as Venetian blinds, Roman shades, honeycomb shades and the like. A window shade can be lowered to cover a window for reducing the amount of light entering a room and thereby providing higher privacy. Most window shades usually include an operating cord operable to raise and lower a bottom rail of the window shade. In particular, the bottom rail may be raised by winding a suspension member around a rotary drum, and lowered by unwinding the suspension member from the rotary drum.

However, one problem with the aforementioned window shades is that the operating cord may inadvertently wrap around the neck of a child, which may cause strangulation accidents. Accordingly, some cordless window shades alternatively propose to use an electric motor or a spring box for raising and lowering the bottom rail. More specifically, a spring box used in a cordless window shade includes multiple springs that can apply a torque for keeping the bottom rail at a desired height. However, the traditional spring box may be relatively complex in construction, and require multiple movable elements to transfer the torque from the springs to the rotary drum, which may adversely increase the size and weight of the spring box. Moreover, the bottom rail may not be suitably kept a desired height if the spring box does not provide a proper torque.

Therefore, there is a need for a spring drive system that can address at least the foregoing issues.

SUMMARY

The present application describes a spring drive system for a window shade, which comprises a housing, a plurality of rotary members, a spring and a latch. The rotary members are rotationally linked to one another and pivotally connected with the housing, wherein the rotary members include a rotary drum that is connected with a suspension member and is rotatable relative to the housing for winding or unwinding the suspension member. The spring is assembled with the housing, and can bias the rotary drum in rotation for winding the suspension member. The latch is assembled with the housing, the latch being movable to engage with and disengage from one of the rotary members to respectively prevent and allow rotation of the rotary drum.

Moreover, the present application provides a window shade including a head rail, a shading structure suspended from the head rail, a bottom part disposed at a bottom of the shading structure, and the spring drive system disposed in the bottom part, the suspension member of the spring drive system being fixedly connected with the head rail.

DETAILED DESCRIPTION OF THE EMBODIMENTS

Figure 1:
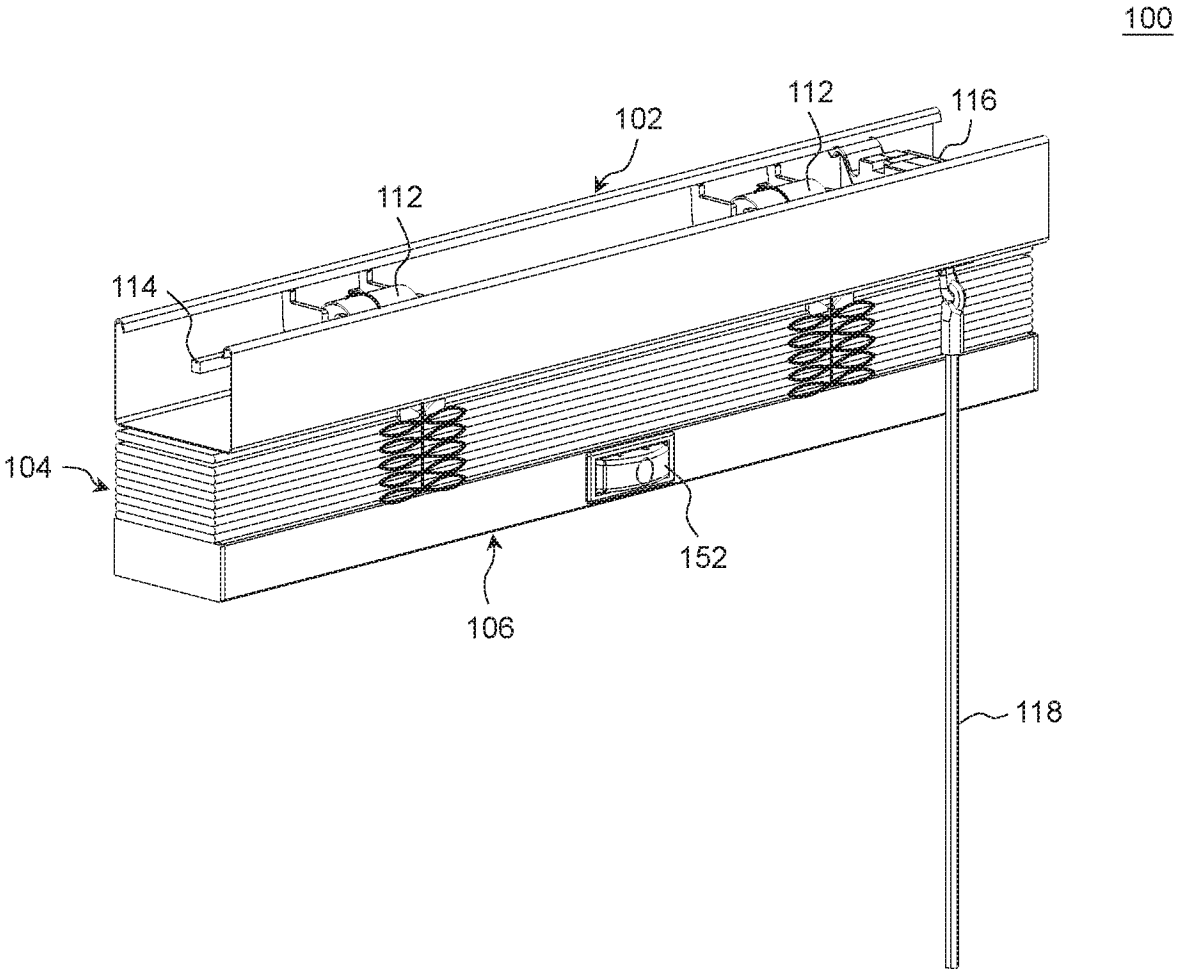
FIG. 1 is a perspective view illustrating an embodiment of a window shade in a retracted or raised state.
Figure 2:
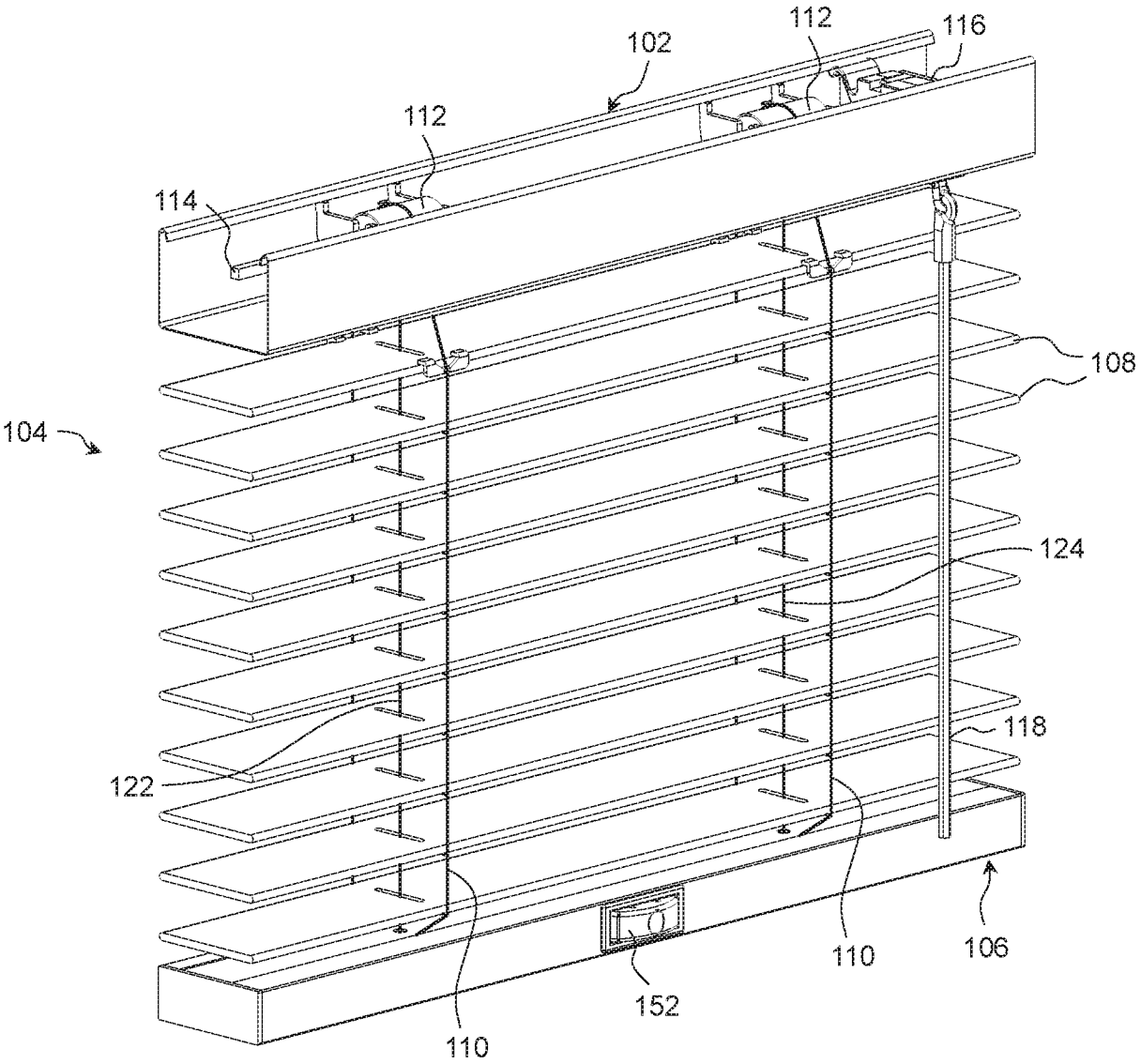
FIG. 2 is a perspective view illustrating the window shade in an expanded state.
Figure 3:
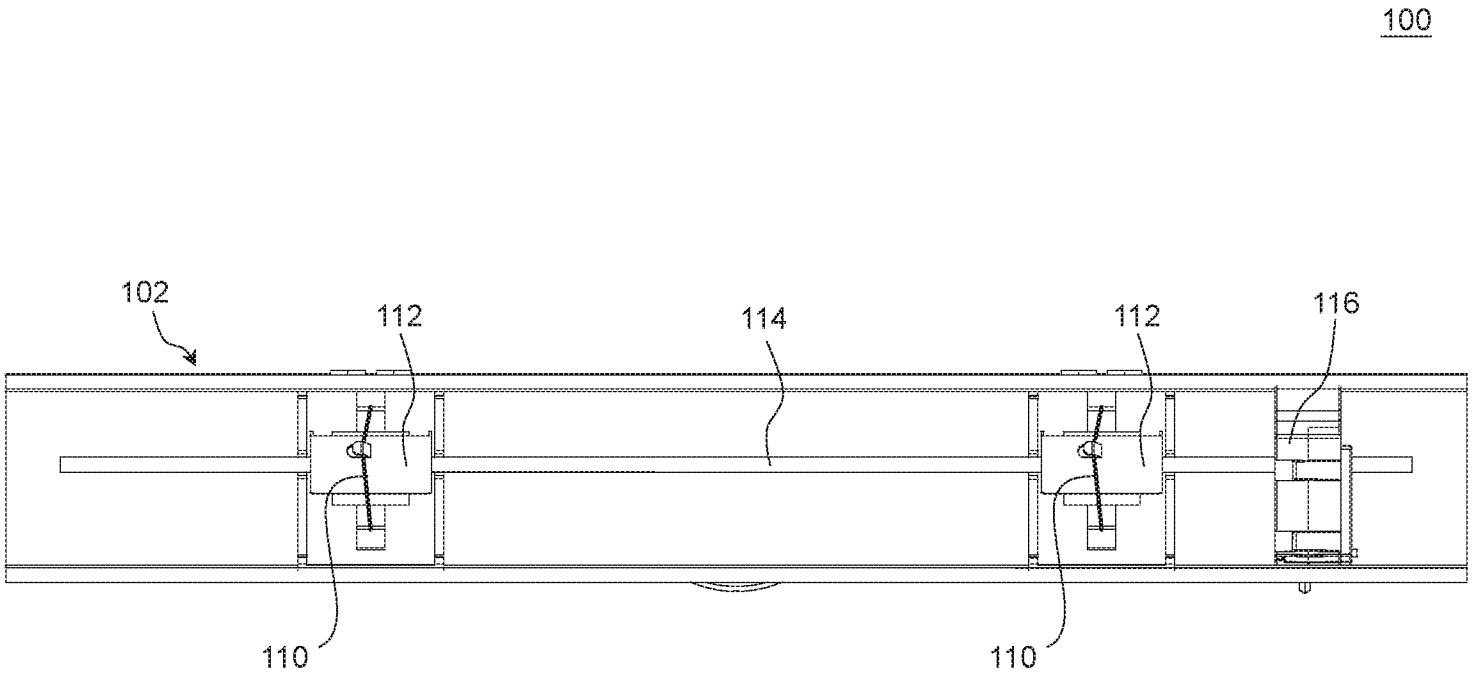
FIG. 3 is a top view of the window shade.
Figure 4:
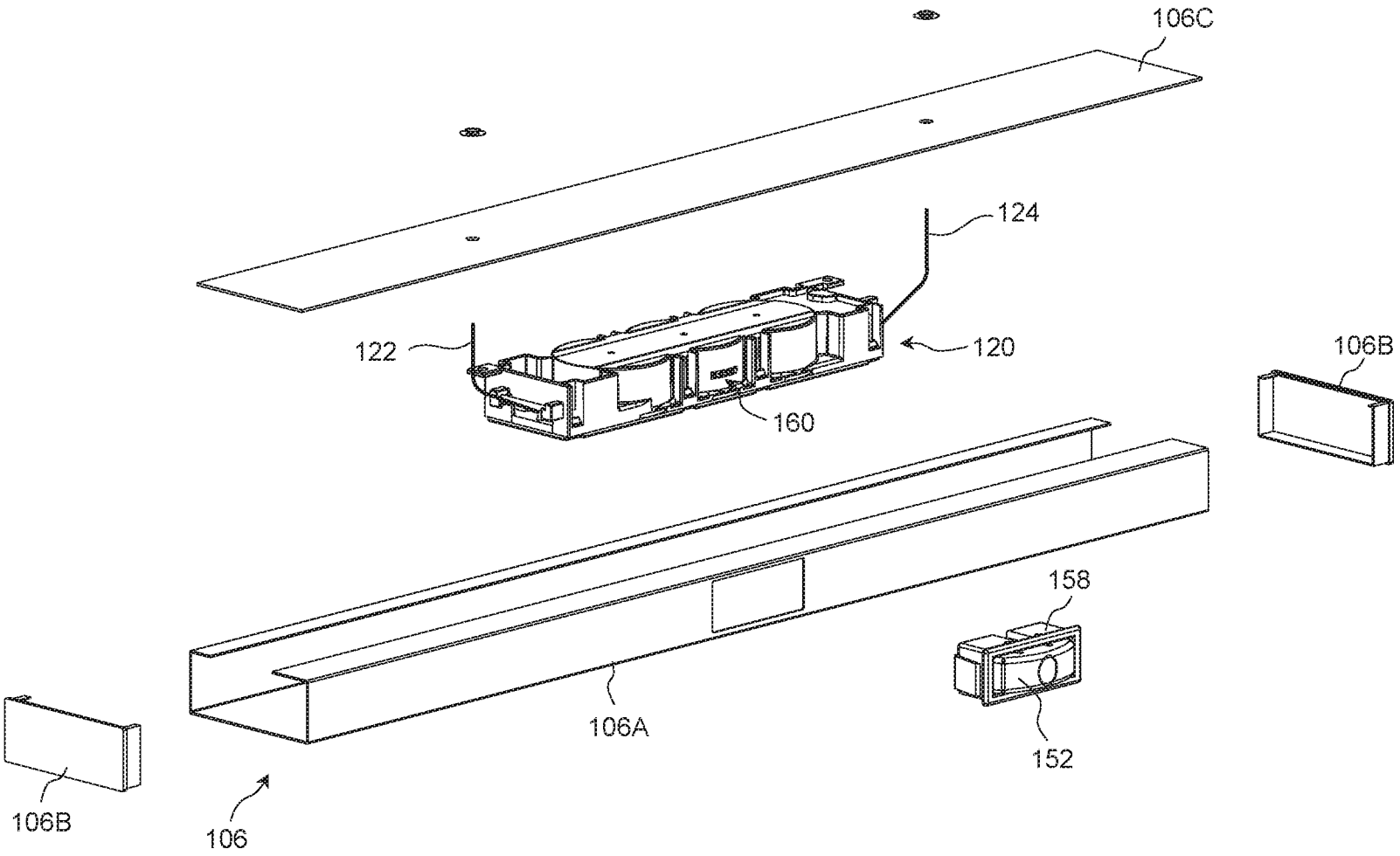
FIG. 4 is an exploded view illustrating construction details in a bottom part of the window shade.

FIG. 1 is a perspective view illustrating an embodiment of a window shade 100 in a retracted or raised state, FIG. 2 is a perspective view illustrating the window shade 100 in an expanded state, and FIG. 3 is a top view illustrating the window shade 100. Referring to FIGS. 1-3, the window shade 100 can include a head rail 102, a shading structure 104, and a bottom part 106 disposed at a bottom of the shading structure 104. The head rail 102 may be of any types and may have any desirable shapes. The head rail 102 may be affixed at a top of a window frame, and the shading structure 104 and the bottom part 106 may be suspended from the head rail 102.

The shading structure 104 can have any suitable construction. The shading structure 104 illustrated in FIGS. 1 and 2 exemplary includes a plurality of shading strips 108. The shading strips 108 can be made of wood or any other suitable materials. The shading strips 108 extend transversally, and have front and rear edges respectively connected with a plurality of ladder cords 110. The ladder cords 110 can be connected with the head rail 102, so that the shading strips 108 can be hung below the head rail 102 via the ladder cords 110.

According to an embodiment, the head rail 102 can include a plurality of actuating assemblies 112, a transmission axle 114, a gear assembly 116 and an operating wand 118. The actuating assemblies 112, the transmission axle 114 and the gear assembly 116 are disposed in the head rail 102. The ladder cords 110 can respectively wrap around the actuating assemblies 112. The transmission axle 114 can be respectively connected with the actuating assemblies 112 and the gear assembly 116. The operating wand 118 can be connected with the gear assembly 116, and can extend outside the head rail 102. The operating wand 118 is rotatable by a user to drive the transmission axle 114 in rotation via the gear assembly 116, and the rotation of the transmission axle 114 in turn urges the actuating assemblies 112 to rotate in unison, which causes the ladder cords 110 to move vertically and thereby adjust an inclination of the shading strips 108.

The bottom part 106 is disposed at a bottom of the shading structure 104, and is movable vertically relative to the head rail 102 to expand and retract the shading structure 104. According to an example of construction, the bottom part 106 can be an elongate and rigid rail. However, it will be appreciated that any types of weighing structures may be suitable for the bottom part 106. According to other examples of construction, the bottom part 106 can be a lowermost part of the shading structure 104.

Figure 5:
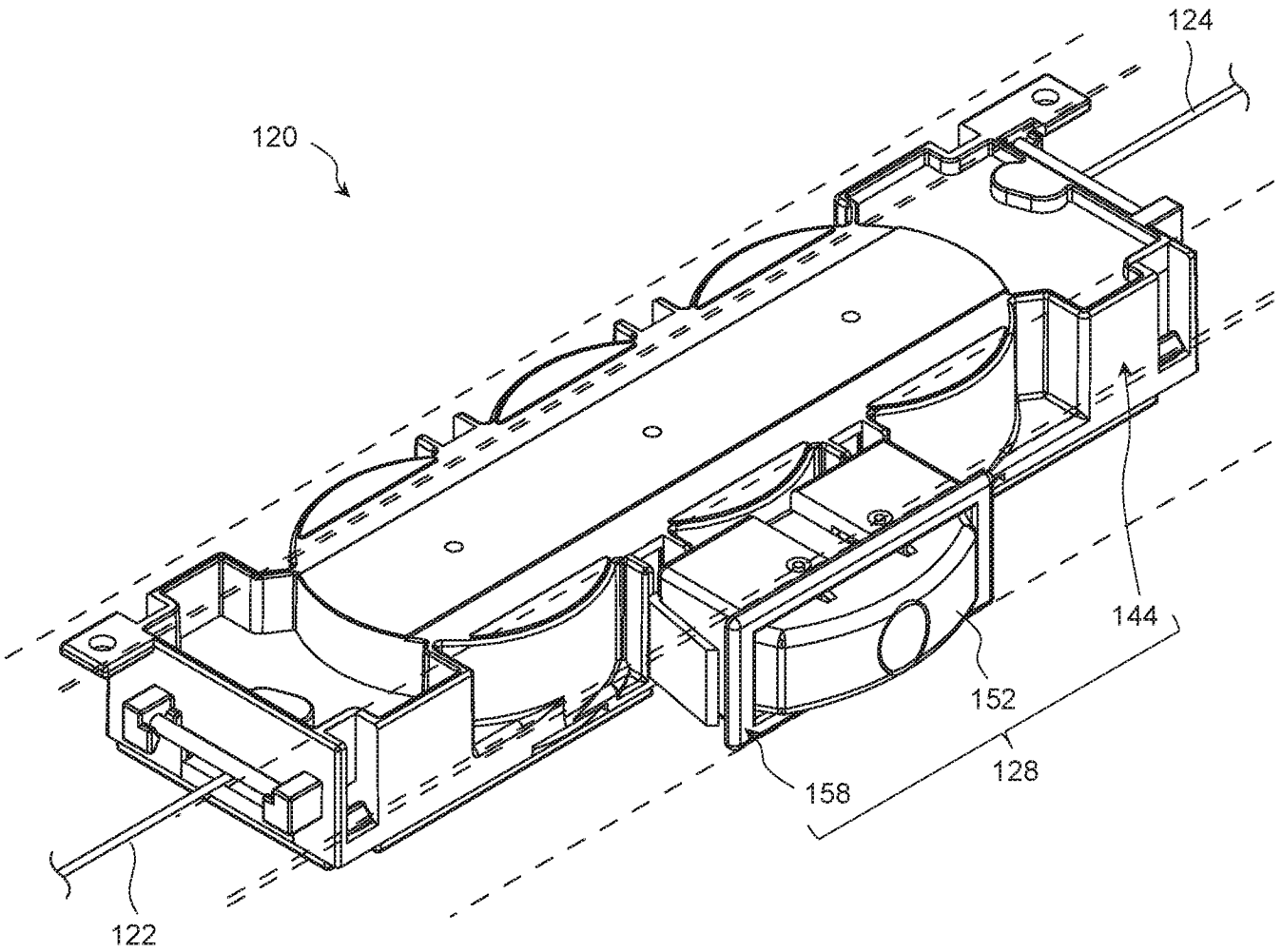
FIG. 5 is a perspective view illustrating a spring drive system provided in the bottom part of the window shade.
Figure 6:
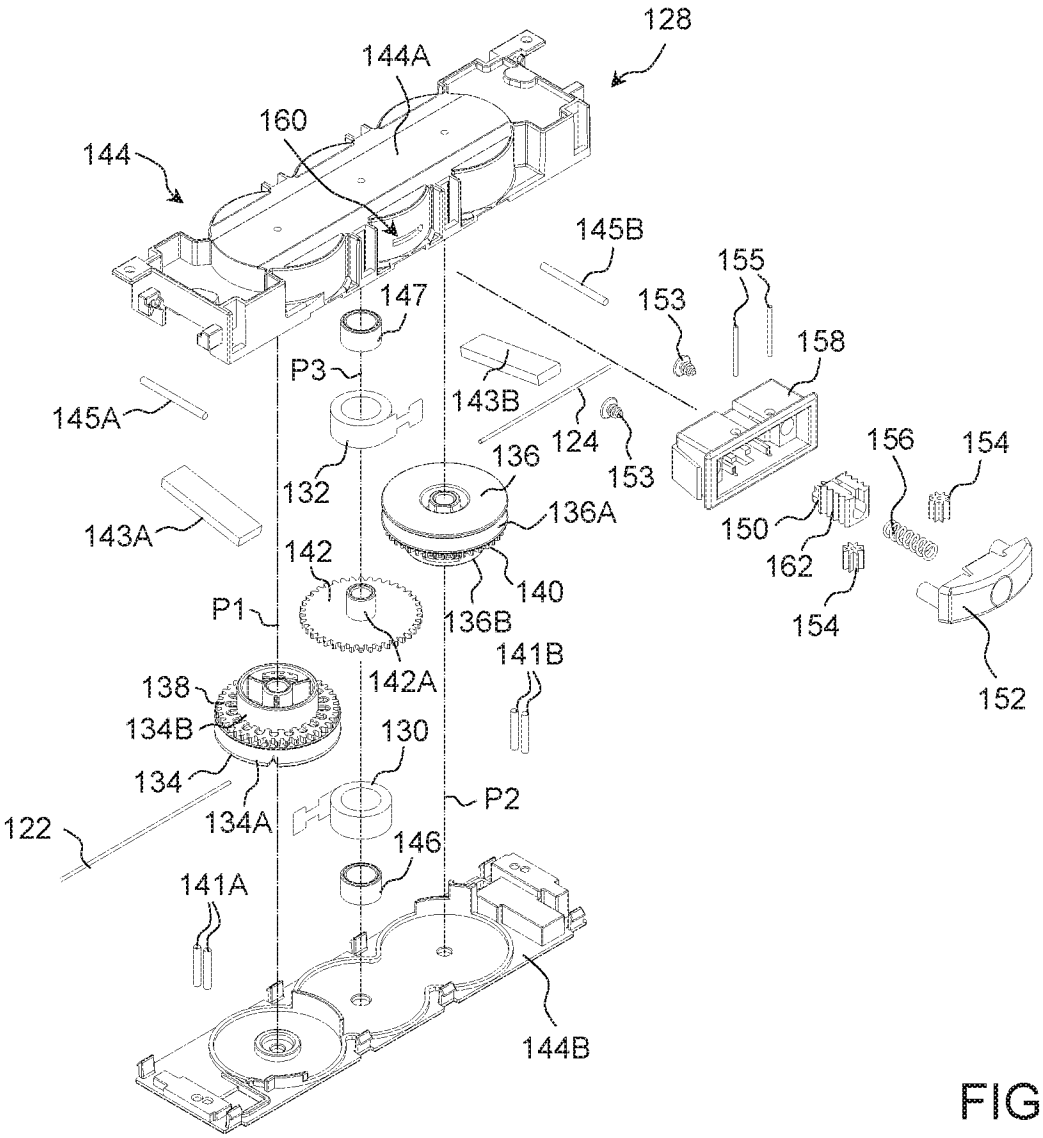
FIG. 6 is an exploded view of the spring drive system.
Figure 7:
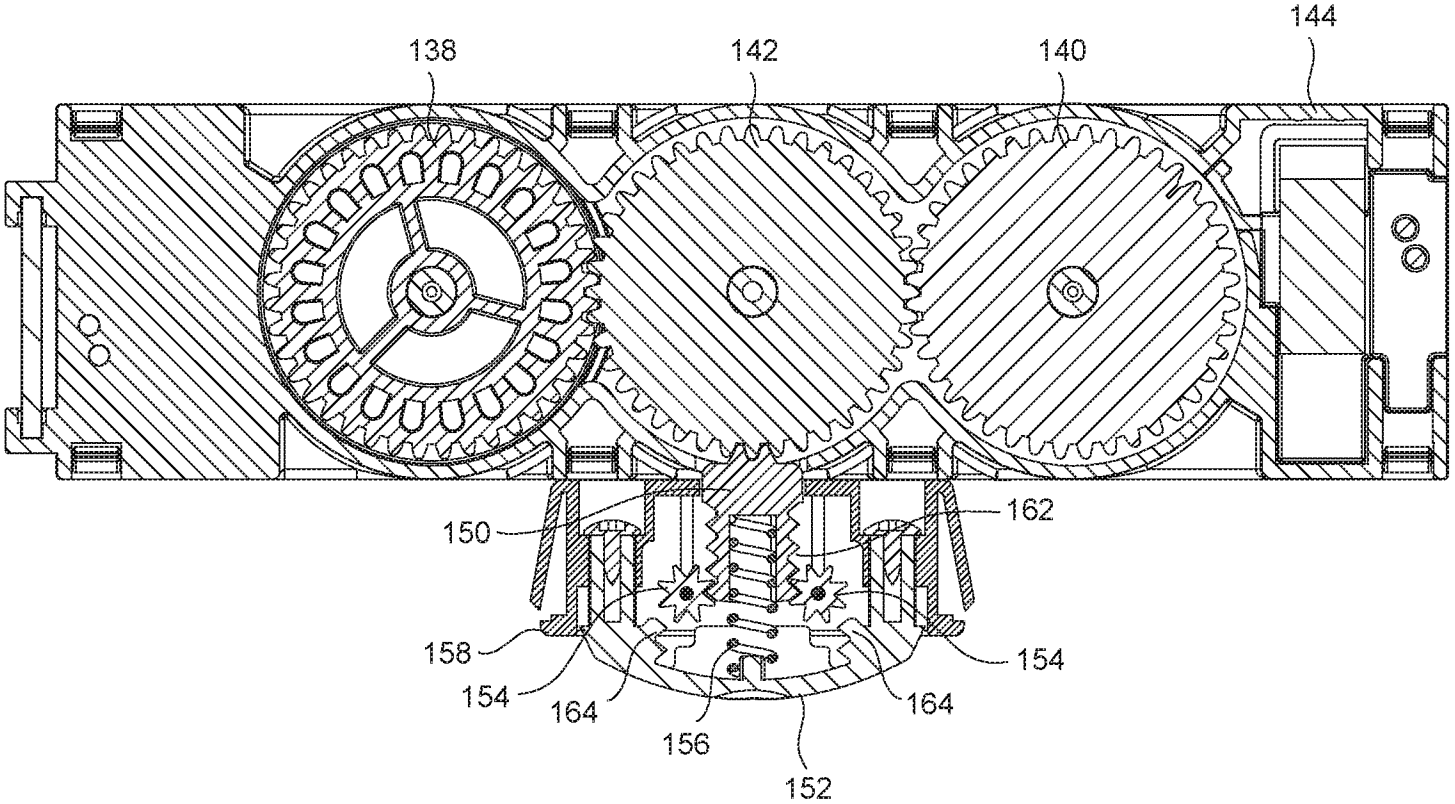
FIG. 7 is a cross-sectional view illustrating the spring drive system in a locked state.

In conjunction with FIGS. 1-3, FIG. 4 is an exploded view illustrating further construction details provided in the bottom part 106, FIG. 5 is a perspective view illustrating a spring drive system 120 provided in the bottom part 106, FIG. 6 is an exploded view of the spring drive system 120, and FIG. 7 is a cross-sectional view of the spring drive system 120. Referring to FIGS. 4-7, the bottom part 106 can include a rail part 106A of an elongate shape, two end caps 106B and a cover strip 106C. The rail part 106A can have a hollow interior defining a receiving space, and the two end caps 106B can be respectively attached fixedly to a left and a right end of the rail part 106A. The spring drive system 120 can be assembled in the receiving space provided in the bottom part 106, and can be covered with the cover strip 106C. The spring drive system 120 can include two suspension members 122 and 124. Each of the two suspension members 122 and 124 can extend generally vertically and can be connected with the head rail 102, whereby the spring drive system 120 and the bottom part 106 can be suspended from the head rail 102. The spring drive system 120 can have a locking state and an unlocking state. In the locking state, the spring drive system 120 can hold and sustain the bottom part 106 in any vertical positions. When the spring drive system 120 switches from the locking state to the unlocking state, the bottom part 106 is allowed to move upward and downward for adjusting a vertical extent of the shading structure 104.

Referring to FIGS. 4-7, the spring drive system 120 can include the two suspension members 122 and 124, a housing 128, two springs 130 and 132, and a plurality of rotary members that are rotationally linked to one another. According to an example of construction, the rotary members can include two rotary drums 134 and 136 and a plurality of gears 138, 140 and 142.

When the spring drive system 120 is assembled in the bottom part 106, the housing 128 can be fixedly connected with the bottom part 106. According to an example of construction, the housing 128 can include a housing portion 144 comprised of an upper cover 144A and a lower cover 144B connected with each other. The upper cover 144A and the lower cover 144B affixed to each other can define at least partially a hollow interior of the housing portion 144 adapted to receive the springs 130 and 132, the rotary drums 134 and 136, and the gears 138, 140 and 142.

The rotary drum 134 and the gear 138 are fixedly connected with each other, and the rotary drum 134 can respectively have two surfaces 134A and 134B at two opposite sides of the gear 138. Moreover, the rotary drum 134 and the gear 138 can be pivotally connected with the housing portion 144 in a coaxial manner about a pivot axis P1, whereby the rotary drum 134 and the gear 138 can rotate in unison about the pivot axis P1 relative to the housing 128.

The rotary drum 136 and the gear 140 are fixedly connected with each other, and the rotary drum 136 can respectively have two surfaces 136A and 136B at two opposite sides of the gear 140. Moreover, the rotary drum 136 and the gear 140 can be pivotally connected with the housing portion 144 in a coaxial manner about a pivot axis P2, whereby the rotary drum 136 and the gear 140 can rotate in unison about the pivot axis P2 relative to the housing 128.

The gear 142 can be fixedly connected with two shaft portions 142A projecting symmetrically at two opposite sides thereof. The gear 142 and the shaft portions 142A can be pivotally connected with the housing portion 144 in a coaxial manner about a pivot axis P3, and the gear 142 can respectively mesh with the gears 138 and 140. The pivot axes P1, P2 and P3 are parallel to one another, and the gear 142 and the shaft portions 142A are rotatable in unison about the pivot axis P3 relative to the housing 128. Through the coupling between the rotary drums 134 and 136 and the gears 138, 140 and 142, the rotary drums 134 and 136 and the gears 138, 140 and 142 are rotationally linked to one another and therefore can rotate in unison relative to the housing 128.

The suspension members 122 and 124 can be exemplary cords or strips. The suspension member 122 can extend vertically through the shading structure 104, and can have two opposite ends respectively attached to the head rail 102 and the surface 134A of the rotary drum 134. The suspension member 124 can extend vertically through the shading structure 104, and can have two opposite ends respectively attached to the head rail 102 and the surface 136A of the rotary drum 136. Through the meshing engagement between the gear 142 and the two rotary drums 134 and 136 (i.e., via the gears 138 and 140), the two rotary drums 134 and 136 can rotate in unison for respectively winding or unwinding the suspension members 122 and 124.

Referring to FIG. 6, a set of rods 141A and 141B and tensioning plates 143A and 143B can be disposed in the housing portion 144. The rods 141A and 141B can respectively guide movement of the suspension members 122 and 124 along a horizontal plane, and the tensioning plates 143A and 143B can respectively press against the suspension members 122 and 124 so that the suspension members 122 and 124 can be wound around the rotary drums 134 and 136 with a suitable tension. Moreover, the housing portion 144 can be fixedly connected with two transversal shafts 145A and 145B about which the suspension members 122 and 124 can respectively wrap and turn from a generally horizontal direction to a generally vertical direction.

For assembling the springs 130 and 132 in the housing 128, two spools 146 and 147 can be respectively connected pivotally with two opposite sides of the gear 142 about two shaft portions 142A. The two spools 146 and 147 can be disposed coaxial to the gear 142, and can respectively rotate independently about the pivot axis P3 relative to the gear 142 and the housing 128. The spring 130 can be a ribbon spring, and can be disposed around the spool 146. The spring 130, the gear 142 and the spool 146 can be assembled with the housing 128 coaxially about the same pivot axis P3. Two ends of the spring 130 can be respectively attached to the surface 134B of the rotary drum 134 and the spool 146. Accordingly, the suspension member 122 and the spring 130 can be commonly connected with the rotary drum 134 at two opposite sides of the gear 138.

The spring 132 can be a ribbon spring, and can be disposed around the spool 147. The spring 132, the gear 142 and the spool 147 can be assembled with the housing 128 coaxially about the same pivot axis P3. Two ends of the spring 132 can be respectively attached to the surface 136B of the rotary drum 136 and the spool 147. Accordingly, the suspension member 124 and the spring 132 can be commonly connected with the rotary drum 136 at two opposite sides of the gear 140.

When the rotary drums 134 and 136 rotate for unwinding the suspension members 122 and 124, the springs 130 and 132 can respectively unwind from the spools 146 and 147 and respectively wind around the surface 134B of the rotary drum 134 and the surface 136B of the rotary drum 136. Moreover, a spring force exerted by the springs 130 and 132 can respectively cause the springs 130 and 132 to unwind from the rotary drums 134 and 136 and thereby urge the rotary drums 134 and 136 in rotation for winding the suspension members 122 and 124.

Referring to FIGS. 4-7, the spring drive system 120 can further include a latch 150, a release actuator 152, a plurality of gears 154 and a spring 156. The latch 150 is assembled with the housing 128, and is movable to engage with and disengage from one of the aforementioned rotary members (i.e., including the rotary drums 134 and 136 and the gears 138, 140 and 142) for respectively preventing and allowing rotation of the rotary members that are rotationally linked to one another. According to an example of construction, the latch 150 is movable to engage with or disengage from the gear 142. It will be appreciated, however, that other embodiments can have the latch 150 movable to engage with or disengage from any one of the rotary drums 134 and 136 and the gears 138, 140 and 142 to prevent or allow rotation of the rotary members. For facilitating the assembly of the latch 150, the release actuator 152, the gear 154 and the spring 156, the housing 128 can include another housing portion 158 fixedly connected with the housing portion 144. The housing portion 158 can protrude from a side of the housing portion 144, and the latch 150, the release actuator 152, the gear 154 and the spring 156 can be received at least partially in the housing portion 158.

The latch 150 is slidably assembled with the housing portion 158, and can slide relative to the housing 128 to engage with and disengage from the gear 142. According to an example of construction, the housing portion 144 can have an opening 160, and the latch 150 can slide through the opening 160 to engage with or disengage from the gear 142. The engagement of the latch 150 with the gear 142 can prevent the rotary drums 134 and 136 and the gears 138, 140 and 142 from rotating, and the disengagement of the latch 150 from the gear 142 allows rotation of the rotary drums 134 and 136 and the gears 138, 140 and 142.

Referring to FIGS. 4-7, the release actuator 152 is slidably assembled with the housing portion 158, and is exposed outward for operation. According to an example of construction, the release actuator 152 can be assembled with the housing portion 158 via a screw 153. The release actuator 152 and the latch 150 can slide parallel to each other relative to the housing 128 along a same axis. The release actuator 152 is operatively connectible with the latch 150 so that actuation of the release actuator 152 can urge the latch 150 to move and disengage from the gear 142. According to an example of construction, the release actuator 152 can be connected with the latch 150 via gears 154. More specifically, the latch 150 can have a threaded portion 162, the gears 154 can respectively mesh with the threaded portion 162 at two sides thereof and can be respectively connected pivotally with the housing portion 158 via shafts 155, and the release actuator 152 can have a plurality of protruding teeth 164. The threaded portion 162 can be fixedly connected with the latch 150, e.g., the threaded portion 162 can be formed integrally with the latch 150 as a single part. A sliding displacement of the release actuator 152 relative to the housing 128 between a first position shown in FIG. 7 and a second position shown in FIG. 8 can urge the latch 150 to slide. More specifically, the latch 150 is engaged with the gear 142 when the release actuator 152 is in the first position, which corresponds to a locked state of the spring drive system 120. The latch 150 is disengaged from the gear 142 when the release actuator 152 is in the second position, which corresponds to an unlocked state of the spring drive system 120.

Figure 8:
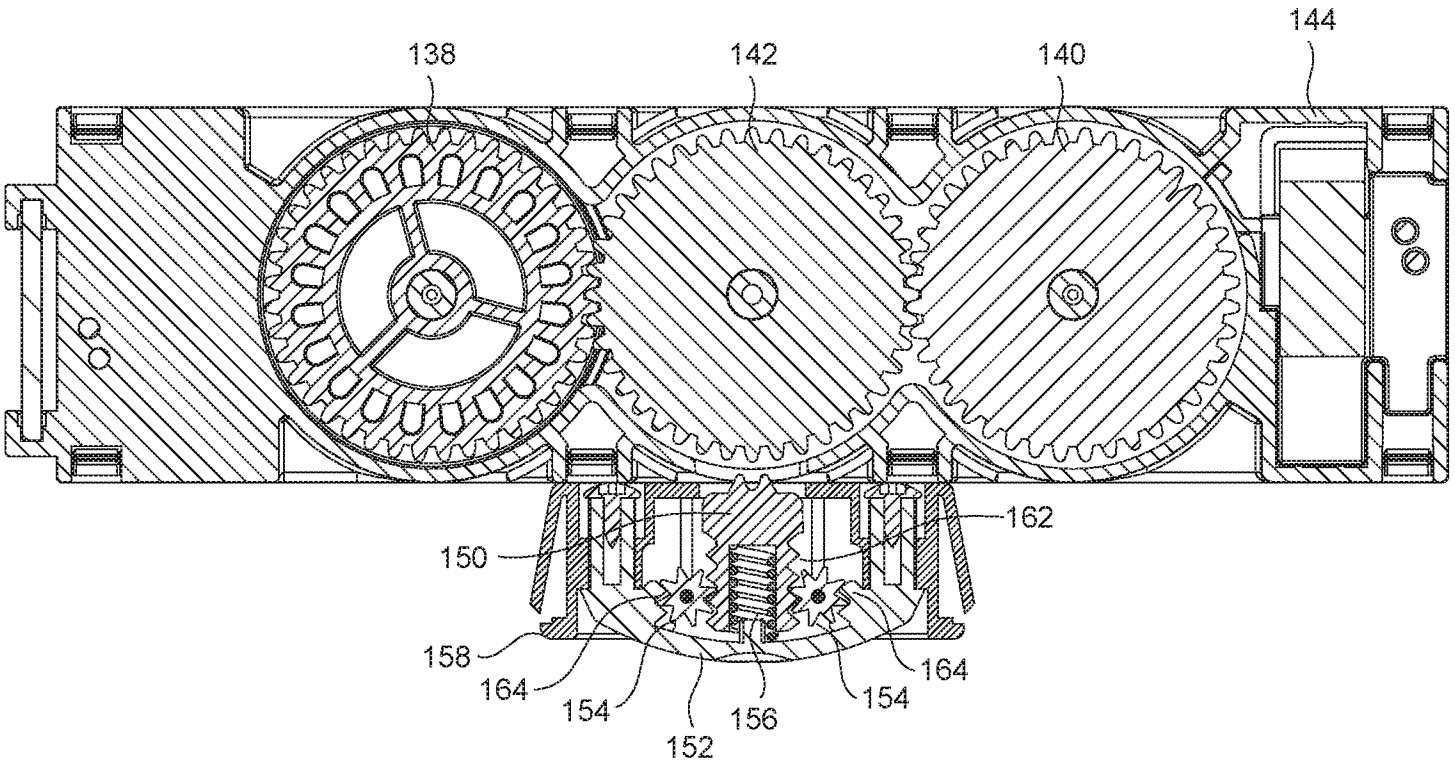
FIG. 8 is a cross-sectional view illustrating the spring drive system in an unlocked state.
Figure 10:
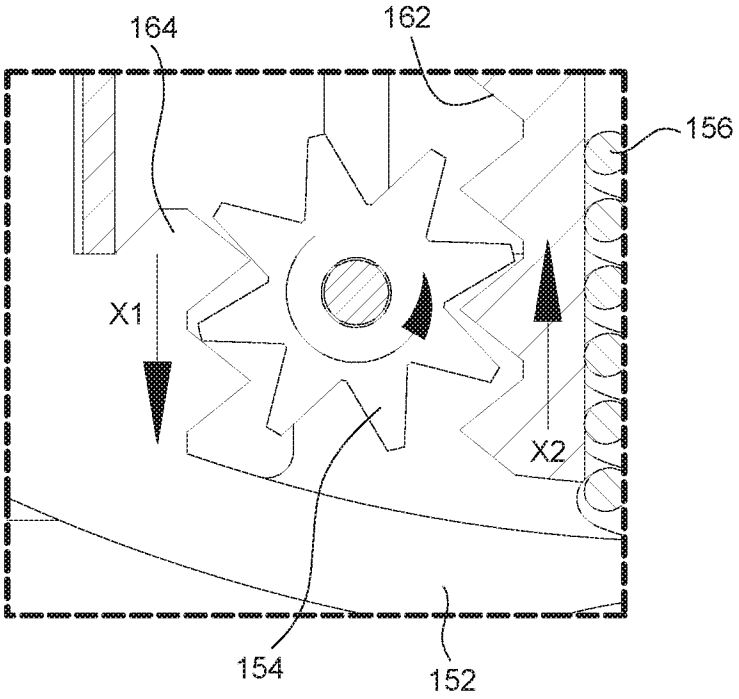
FIG. 10 is an enlarged view illustrating the release actuator of the spring drive system moving toward the locked state.
Figure 9:
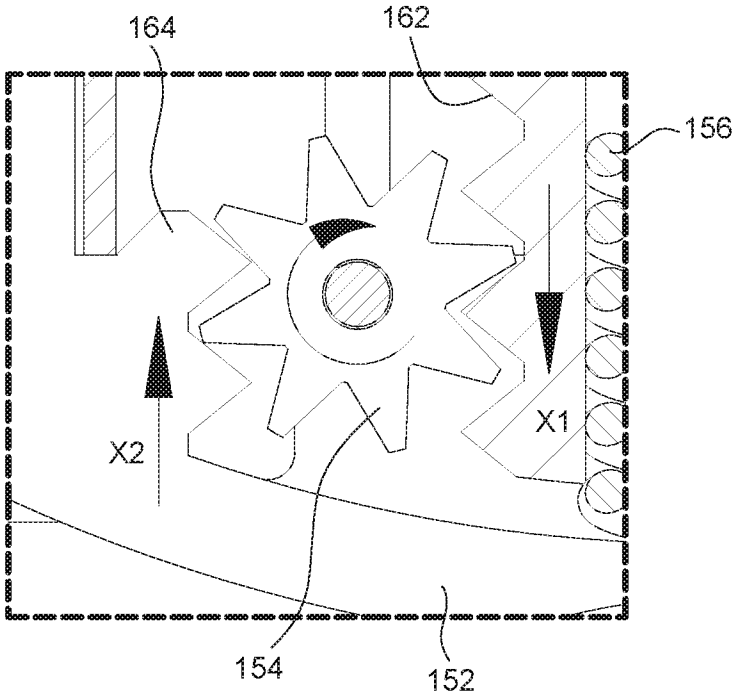
FIG. 9 is an enlarged view illustrating a release actuator of the spring drive system moving toward the unlocked state.

FIGS. 9 and 10 are enlarged views respectively illustrating the release actuator 152 moving toward the unlocked state and the locked state. Referring to FIGS. 8 and 9, when the release actuator 152 moves in a direction X2 (i.e., toward an interior of the housing portion 158), the teeth 164 of the release actuator 152 can respectively urge the gears 154 to rotate, which in turn urge the latch 150 to move in a direction X2 opposite to the direction X1 and disengage from the gear 142. Referring to FIGS. 7 and 10, as the latch 150 slides in the direction X2 and engages with the gear 142, the latch 150 can urge gears 154 to rotate, which can urge the release actuator 152 to slide in the direction X1 opposite to the direction X2 (i.e., in the direction for protruding outward the housing portion 158).

Referring to FIGS. 4-8, the spring 156 is connected with the latch 150. The spring 156 can bias the latch 150 to slide in the direction X2, and keep the latch 150 engaged with the gear 142. According to an example of construction, two ends of the spring 156 can be respectively connected with the latch 150 and the release actuator 152, so that the spring 156 can apply a spring force on the release actuator 152 for assisting the release actuator 152 to move and recover the first position of FIG. 7.

Figure 11:
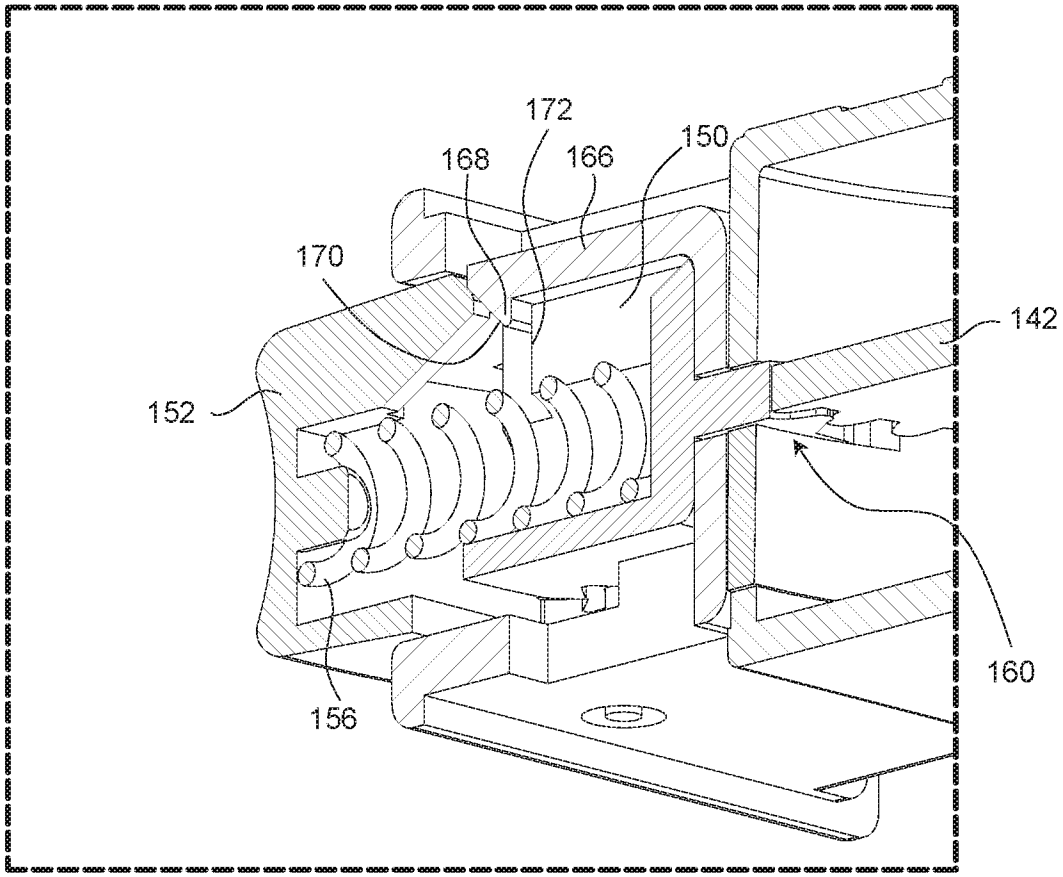
FIGS. 11 and 12 are cross-sectional views illustrating a safety lock mechanism provided in the spring drive system.
Figure 12:
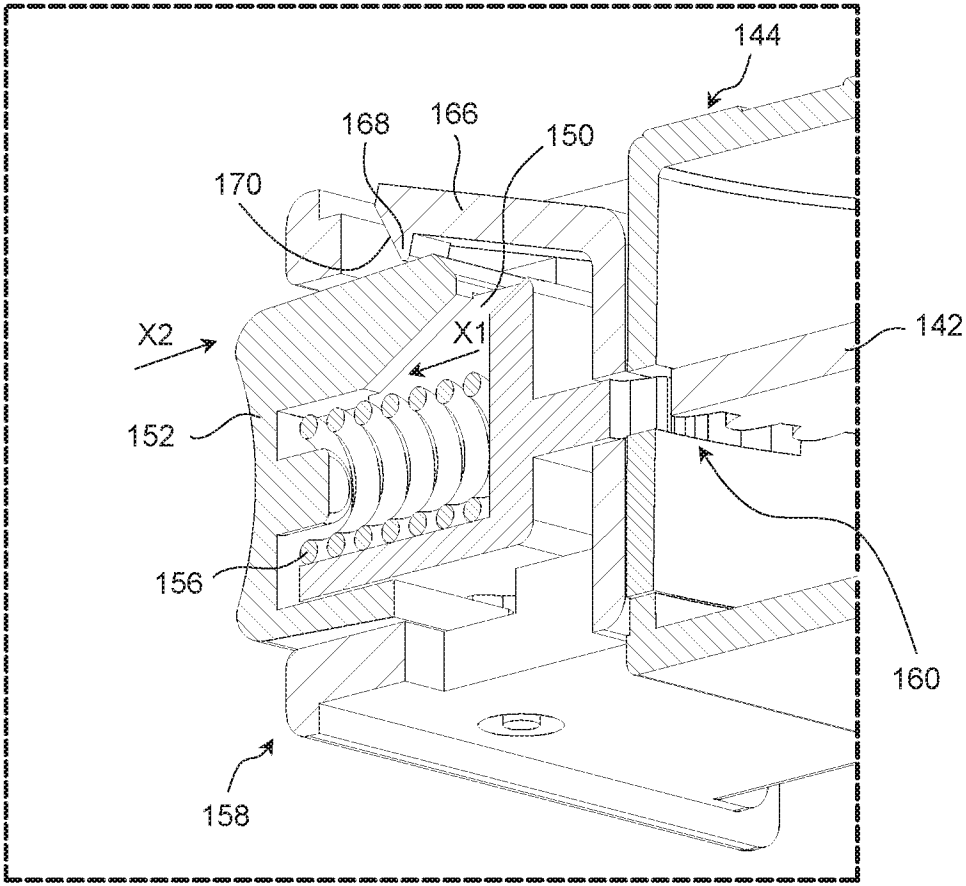

According to an embodiment, the spring drive system 120 can further include a safety lock mechanism that can prevent unwanted movement of the latch 150 in the direction X1 and accidental unlocking thereof induced by an excessive torque applied by the gear 142 while the spring drive system 120 is in the locked state. Referring to FIGS. 11 and 12, this safety lock mechanism can include an impeding portion 166, which can be connected with the housing portion 158. According to an example of construction, the impeding portion 166 can be a resilient part having a protrusion 168, and a ramp surface 170 at a side of the impeding portion 166.

Referring to FIG. 11, when the latch 150 is engaged with the gear 142, the impeding portion 166 is in a blocking position with the protrusion 168 thereof in contact with a side edge 172 of the latch 150, which prevents the latch 150 from sliding in an unlocking direction and disengaging from the gear 142.

Referring to FIG. 12, as the release actuator 152 is depressed and slides in the direction X2, the release actuator 152 can push against the ramp surface 170 of the impeding portion 166 and thereby urge the impeding portion 166 to move relative to the housing 128 from the blocking position to a clearing position that allows the side edge 172 of the latch 150 to slide in the direction X1 past the protrusion 168 of the impeding portion 166. The latch 150 is thereby allowed to slide and disengage from the gear 142. When the latch 150 recovers its engagement with the gear 142, the impeding portion 166 can elastically move from the clearing position shown in FIG. 12 to the blocking position shown in FIG. 11.

Referring to FIGS. 1, 2 and 4-6, when the spring drive system 120 is assembled in the bottom part 106, the gears 138, 140 and 142 can be disposed generally horizontally, the pivot axes P1, P2 and P3 can extend generally vertically, and the release actuator 152 is exposed at a side of the bottom part 106 for operation.

Figure 13:
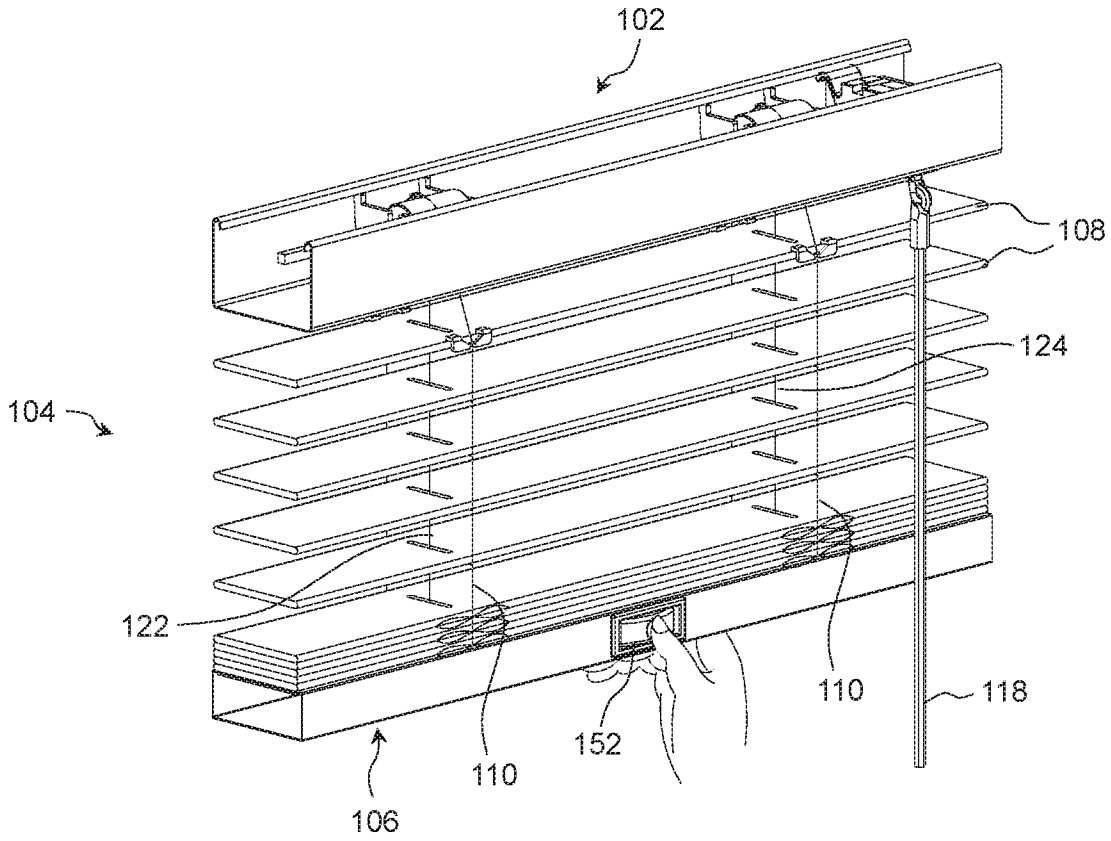
FIGS. 13 and 14 are perspective views illustrating exemplary operation of the window shade.

In conjunction with FIGS. 1-12, FIGS. 13 and 14 are schematic views illustrating exemplary operation of the window shade 100. Referring to FIG. 13, when the bottom part 106 is to be adjusted vertically, a user can first depress the release actuator 152. As shown in FIG. 9, the depressed release actuator 152 can move in the direction X2 toward the interior of the housing portion 158, which causes the latch 150 to move in the direction X1 opposite to the direction X2 via the interaction of the gears 154. The latch 150 can thereby disengage from the gear 142, which switches the spring drive system 120 from the locked state to the unlocked state.

While the release actuator 152 is kept in the depressed state, the user can move the bottom part 106 upward or downward to a desired vertical position. As the bottom part 106 moves upward, the spring 130 and 132 can urge rotary drums 134 and 136 to rotate for winding the suspension members 122 and 124. As the bottom part 106 moves downward, the rotary drums 134 and 136 can be urged to rotate for unwinding the suspension members 122 and 124.

Figure 14:
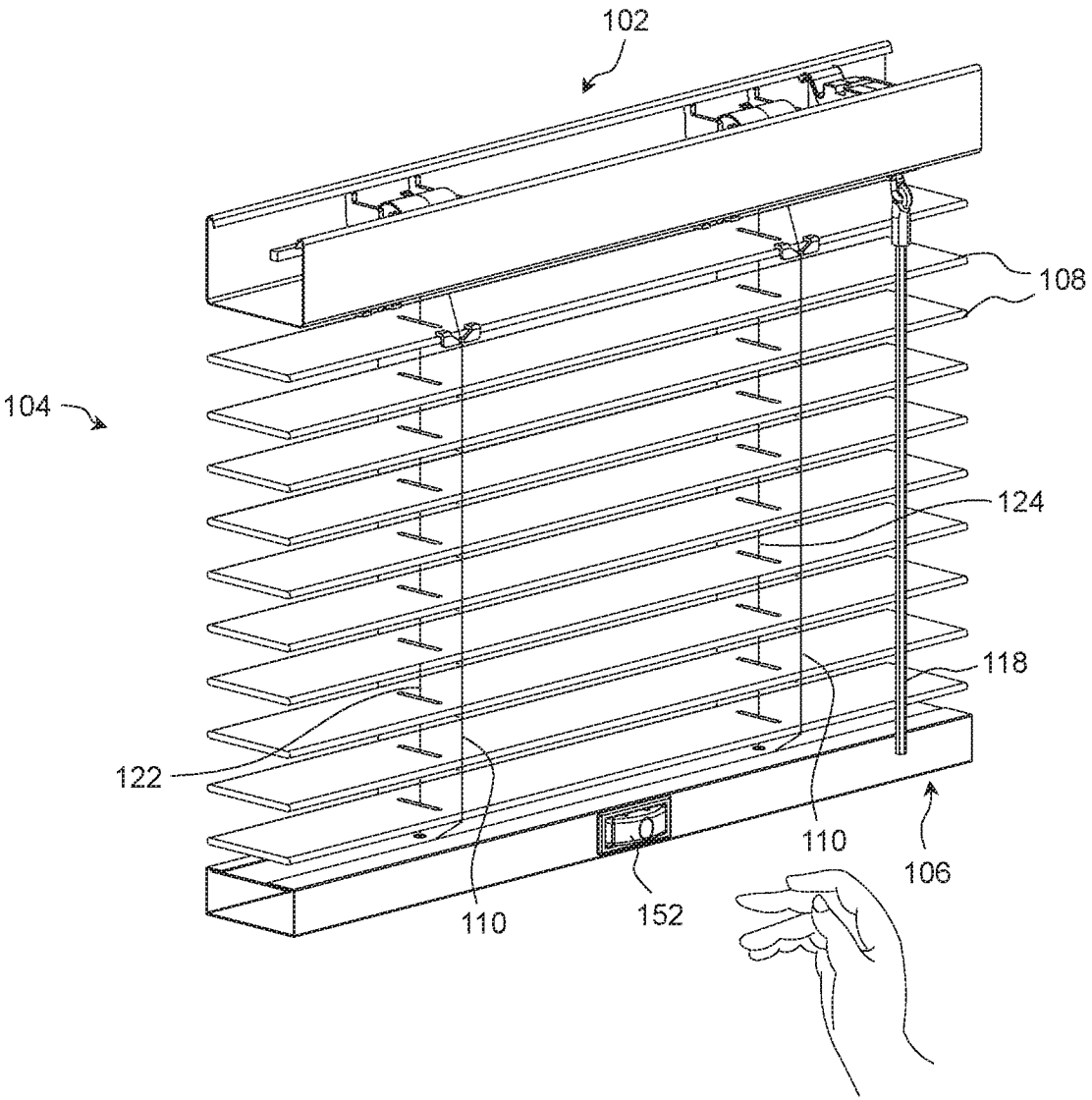

Referring to FIG. 14, when the bottom part 106 reaches a desired vertical position, the user can release the release actuator 152. As a result, as shown in FIG. 10, the spring 156 can urge the latch 150 to slide in the direction X2 and engage with the gear 142. Moreover, the spring 156 can also urge the release actuator 152 to slide in the direction X1 relative to the housing 128 until the release actuator 152 recovers its initial first position. The spring drive system 120 can thereby switch from the unlocked state to the locked state. The engagement of the latch 150 with the gear 142 can prevent the rotary drums 134 and 136 and the gears 138, 140 and 142 from rotating, and the bottom part 106 can be thereby maintained stationary in position.

Figure 15:
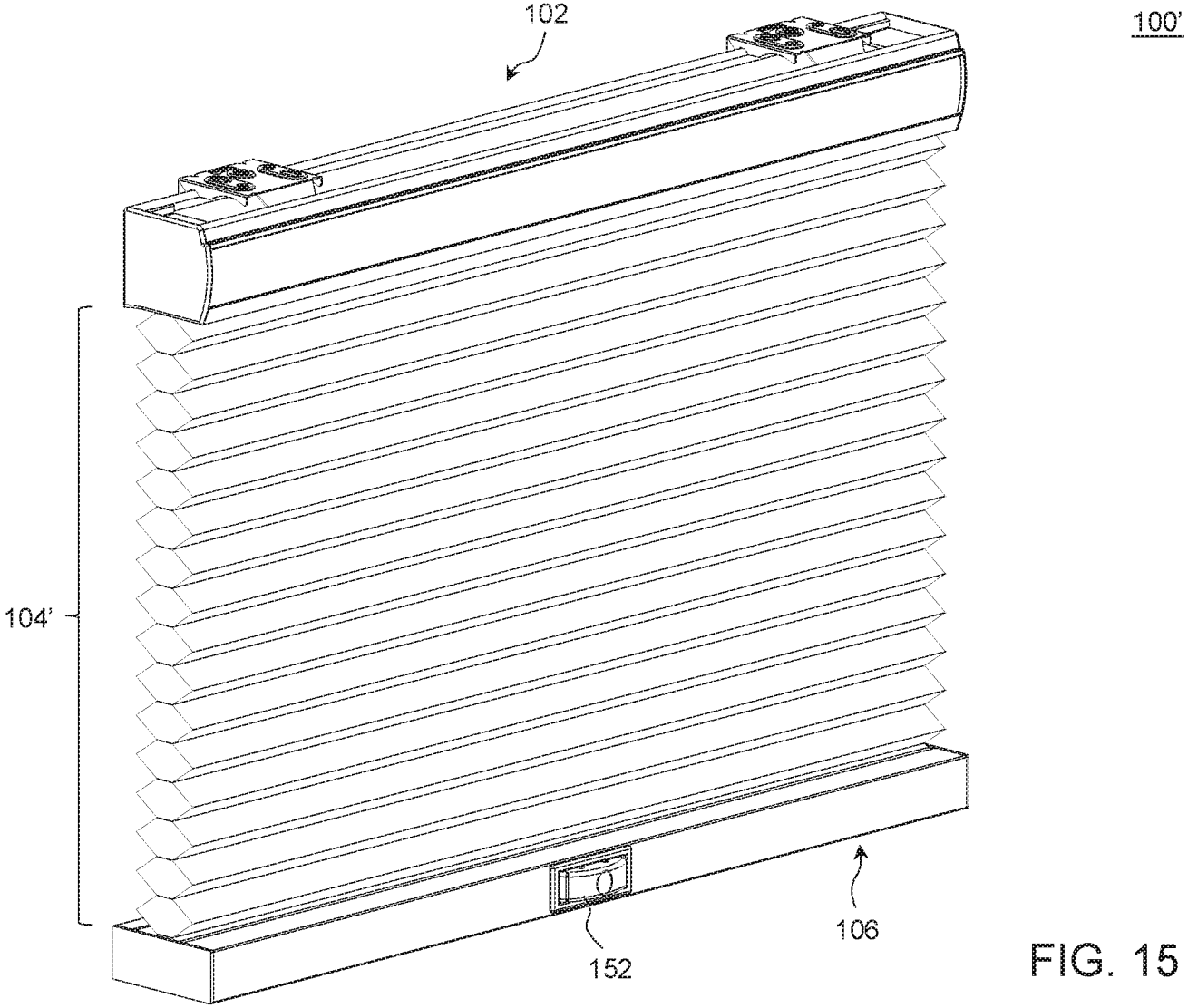
FIG. 15 is a perspective view illustrating another type of window shade that may incorporate the spring drive system described herein.
Figure 16:
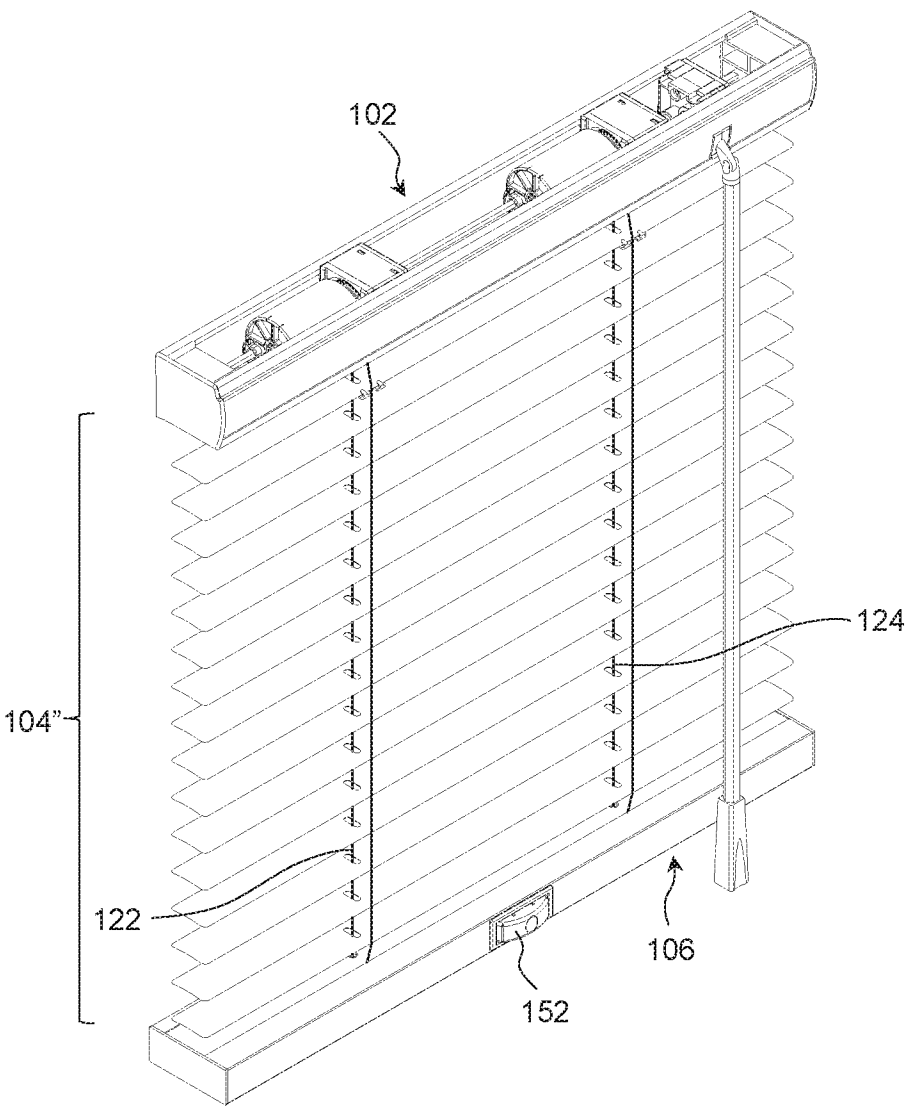
FIG. 16 is a perspective view illustrating another type of window shade that may incorporate the spring drive system described herein.

The spring drive system 120 described herein may be suitable for use with different types of window shades. For example, FIG. 15 is a perspective view illustrating another window shade 100' that may incorporate the spring drive system 120 described herein, wherein the shading structure 104' of the window shade 100' may be comprised of a honeycomb or cellular structure. FIG. 16 is a perspective view illustrating another window shade 100" that may incorporate the spring drive system 120 described herein, wherein the shading structure 104" of the window shade 100" may be comprised of a plurality of shading strips that may be aluminum slats.

The spring drive system described herein can be fabricated and assembled in a cost-effective manner, and can have multiple advantages. For example, the spring drive system includes a latching mechanism that can effectively prevent undesirable rotation of the rotary members included in the spring drive system, which may occur when the spring force initially provided by the spring drive system is insufficient to counterbalance the weight of the shading structure and the bottom part. As a result, the shading structure and the bottom part can be adjusted and effectively kept at any vertical positions as desired.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. A spring drive system for a window shade, comprising:

a housing;

a plurality of rotary members rotationally linked to one another and pivotally connected with the housing, wherein the rotary members include a rotary drum that is connected with a suspension member and is rotatable relative to the housing for winding or unwinding the suspension member;

a spring assembled with the housing, the spring biasing the rotary drum in rotation for winding the suspension member;

a latch assembled with the housing, the latch being movable to engage with and disengage from one of the rotary members to respectively prevent and allow rotation of the rotary drum; and a release actuator assembled with the housing and exposed for operation, the release actuator being operable to cause the latch to move and disengage from the one of the rotary members;

wherein the housing is connected with an impeding portion, the impeding portion being movable between a blocking position and a clearing position, the impeding portion preventing the latch from disengaging from the one of the rotary members in the blocking position, and the impeding portion allowing the latch to slide and disengage from the one of the rotary members in the clearing position, and the release actuator is operable to cause the impeding portion to move from the blocking position to the clearing position.

2. The spring drive system according to claim 1, wherein one end of the spring is connected with the rotary drum.

3. The spring drive system according to claim 1, wherein the rotary members include a gear, an engagement of the latch with the gear preventing the rotary drum from rotating, and a disengagement of the latch from the gear allowing rotation of the rotary drum.

4. The spring drive system according to claim 1, wherein the rotary members include a first and a second gear, the second gear being fixedly connected with the rotary drum and meshed with the first gear, the latch being engaged with the first gear to prevent the rotary drum from rotating, and the latch being disengaged from the first gear for rotation of the rotary drum.

5. The spring drive system according to claim 4, wherein the spring and the first gear are assembled with the housing about a same pivot axis, a first end of the spring being connected with a spool, and a second end of the spring being connected with the rotary drum.

6. The spring drive system according to claim 1, wherein the housing includes a first and a second housing portion fixedly connected with each other, the second housing portion protruding from a side of the first housing portion, the rotary members and the spring being received at least partially in the first housing portion, the release actuator being received at least partially in the second housing portion.

7. The spring drive system according to claim 6, wherein the first housing portion has an opening, and the latch is movable through the opening to engage with and disengage from the one of the rotary members.

8. The spring drive system according to claim 6, wherein the latch and the release actuator are slidably assembled with the second housing portion.

9. The spring drive system according to claim 1, wherein the latch and the release actuator are slidably assembled with the housing, a movement of the release actuator in a first direction causing the latch to move in a second direction opposite to the first direction for disengaging from the one of the rotary members.

10. The spring drive system according to claim 1, wherein the latch and the release actuator are slidably assembled with the housing, and the housing being pivotally connected with a gear that is meshed with the latch, the release actuator being operable to urge the gear to rotate and thereby cause the latch to slide and disengage from the one of the rotary members.

11. The spring drive system according to claim 10, wherein the latch is connected with a second spring, the second spring biasing the latch to slide for engaging with the one of the rotary members.

12. The spring drive system according to claim 11, wherein the second spring is respectively connected with the latch and the release actuator.

13. A window shade comprising:

a head rail;

a shading structure suspended from the head rail;

a bottom part disposed at a bottom of the shading structure; and the spring drive system according to claim 1 disposed in the bottom part, the suspension member of the spring drive system being fixedly connected with the head rail.

14. The window shade according to claim 13, wherein the shading structure includes a plurality of strips.

15. The window shade according to claim 13, wherein the shading structure includes a honeycomb or cellular structure.

16. A spring drive system for a window shade, comprising:

a housing;

a plurality of rotary members rotationally linked to one another and pivotally connected with the housing, wherein the rotary members include a rotary drum that is connected with a suspension member and is rotatable relative to the housing for winding or unwinding the suspension member;

a spring assembled with the housing, the spring biasing the rotary drum in rotation for winding the suspension member;

a latch assembled with the housing, the latch being movable to engage with and disengage from one of the rotary members to respectively prevent and allow rotation of the rotary drum; and a release actuator assembled with the housing and exposed for operation, the release actuator being operable to cause the latch to move and disengage from the one of the rotary members;

wherein the latch and the release actuator are slidably assembled with the housing, a movement of the release actuator in a first direction causing the latch to move in a second direction opposite to the first direction for disengaging from the one of the rotary members.

17. The spring drive system according to claim 16, wherein the housing is pivotally connected with a gear that is meshed with the latch, the release actuator being operable to urge the gear to rotate and thereby cause the latch to slide and disengage from the one of the rotary members.

18. A spring drive system for a window shade, comprising:

a housing;

a plurality of rotary members rotationally linked to one another and pivotally connected with the housing, wherein the rotary members include a rotary drum that is connected with a suspension member and is rotatable relative to the housing for winding or unwinding the suspension member;

a spring assembled with the housing, the spring biasing the rotary drum in rotation for winding the suspension member;

a latch assembled with the housing, the latch being movable to engage with and disengage from one of the rotary members to respectively prevent and allow rotation of the rotary drum;

a release actuator assembled with the housing and exposed for operation, the release actuator being operable to cause the latch to move and disengage from the one of the rotary members; and an impeding portion connected with the housing, the impeding portion being movable between a blocking position and a clearing position, the impeding portion preventing the latch from disengaging from the one of the rotary members in the blocking position, and the impeding portion allowing the latch to slide and disengage from the one of the rotary members in the clearing position, the release actuator being operable to cause the impeding portion to move from the blocking position to the clearing position.

19. The spring drive system according to claim 18, wherein one end of the spring is connected with the rotary drum.

20. The spring drive system according to claim 18, wherein the rotary members include a gear, an engagement of the latch with the gear preventing the rotary drum from rotating, and a disengagement of the latch from the gear allowing rotation of the rotary drum.

21. The spring drive system according to claim 18, wherein the rotary members include a first and a second gear, the second gear being fixedly connected with the rotary drum and meshed with the first gear, the latch being engaged with the first gear to prevent the rotary drum from rotating, and the latch being disengaged from the first gear for rotation of the rotary drum.

22. The spring drive system according to claim 21, wherein the spring and the second gear are assembled with the housing about a same pivot axis, a first end of the spring being connected with a spool, and a second end of the spring being connected with the rotary drum.

23. The spring drive system according to claim 18, wherein the housing includes a first and a second housing portion fixedly connected with each other, the second housing portion protruding from a side of the first housing portion, the rotary members and the spring being received at least partially in the first housing portion, the release actuator being received at least partially in the second housing portion.

24. The spring drive system according to claim 23, wherein the first housing portion has an opening, and the latch is movable through the opening to engage with and disengage from the one of the rotary members.

25. The spring drive system according to claim 23, wherein the latch and the release actuator are slidably assembled with the second housing portion, a movement of the release actuator in a first direction causing the latch to move in a second direction opposite to the first direction for disengaging from the one of the rotary members.

26. A window shade comprising:

a head rail;

a shading structure suspended from the head rail;

a bottom part disposed at a bottom of the shading structure; and the spring drive system according to claim 18 disposed in the bottom part, the suspension member of the spring drive system being fixedly connected with the head rail.

27. The window shade according to claim 26, wherein the shading structure includes a plurality of strips.

28. The window shade according to claim 26, wherein the shading structure includes a honeycomb or cellular structure.

* * * * *